US007770880B2

(12) United States Patent
Yamazaki

(10) Patent No.: US 7,770,880 B2
(45) Date of Patent: Aug. 10, 2010

(54) IMAGE FORMING APPARATUS, SHEET FEEDING SOURCE SELECTION METHOD, AND RECORDING MEDIUM

(75) Inventor: Yasuko Yamazaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 240 days.

(21) Appl. No.: 11/519,082

(22) Filed: Sep. 12, 2006

(65) Prior Publication Data

US 2007/0057430 A1 Mar. 15, 2007

(30) Foreign Application Priority Data

Sep. 13, 2005 (JP) ..... 2005-265854

(51) Int. Cl.
*B65H 3/44* (2006.01)
*B65H 5/26* (2006.01)

(52) U.S. Cl. ..... 271/9.05; 271/9.01

(58) Field of Classification Search ..... 271/9.01, 271/9.05

See application file for complete search history.

(56) References Cited

U.S. PATENT DOCUMENTS 4,428,501 A * 1/1984 Osako ..... 221/13
4,881,104 A * 11/1989 Kusumoto et al. ..... 399/18
4,885,613 A * 12/1989 Kudoh ..... 399/23
4,953,844 A * 9/1990 Iwata et al. ..... 271/9.01
5,512,928 A * 4/1996 Kato et al. ..... 347/138
5,709,377 A * 1/1998 Yoshioka et al. ..... 271/9.02
6,018,356 A * 1/2000 Morimura et al. ..... 347/215
6,206,360 B1 * 3/2001 Urata et al. ..... 271/9.06
6,487,379 B2 * 11/2002 Sato ..... 399/16
6,515,735 B2 * 2/2003 Takoh ..... 355/72
6,526,253 B2 * 2/2003 Hayashi et al. ..... 399/391
6,701,099 B2 * 3/2004 Yokobori et al. ..... 399/45
6,810,219 B2 * 10/2004 Yokobori et al. ..... 399/45
7,102,766 B2 * 9/2006 Asakawa et al. ..... 358/1.13
7,389,084 B2 * 6/2008 Watanabe et al. ..... 399/391
2003/0020229 A1 * 1/2003 Nishimura ..... 271/9.05
2003/0098540 A1 * 5/2003 Hong ..... 271/9.01
2003/0230842 A1 * 12/2003 Shiho et al. ..... 271/9.01
2004/0056409 A1 * 3/2004 Kawata ..... 271/9.01
2004/0155396 A1 * 8/2004 Han ..... 271/9.01
2004/0184058 A1 * 9/2004 Miyajima ..... 358/1.12
2005/0056988 A1 * 3/2005 Lee et al. ..... 271/9.05
2005/0104272 A1 * 5/2005 Watanabe et al. ..... 271/9.05
2007/0001366 A1 * 1/2007 Yano ..... 271/9.01

FOREIGN PATENT DOCUMENTS

JP 11157684 6/1999

* cited by examiner

*Primary Examiner*—Patrick Mackey
*Assistant Examiner*—Prasad V Gokhale
(74) *Attorney, Agent, or Firm*—Harness, Dickey & Pierce, P.L.C.

(57) ABSTRACT

A technology for selecting a sheet feeding source in an image forming apparatus including a plurality of sheet feeding sources is disclosed. A rank is acquired for each of the sheet feeding sources from a search order. The search order defines ranks for possible setups of sheet feeding sources. Each acquired rank represents a setup of a sheet feeding source, which setup is available in the image forming apparatus. A sheet feeding source that satisfies a user specification and whose rank is highest is selected from among the sheet feeding sources.

15 Claims, 10 Drawing Sheets

IMAGE FORMING APPARATUS, SHEET FEEDING SOURCE SELECTION METHOD, AND RECORDING MEDIUM

BACKGROUND OF THE INVENTION

1. Field of the Invention

The present invention relates generally to image forming apparatuses, sheet feeding source selection methods, and recording media, and more particularly to an image forming apparatus including plural sheet feeding sources, a sheet feeding source selection method and a recording medium for use therein.

2. Description of the Related Art

In recent years and continuing, image forming apparatuses such as multifunction peripherals (MFP) often include plural sheet feeding trays as sheet feeding sources. In such multifunction peripherals, the sheet feeding trays store sheets of different sizes; and therefore, a sheet feeding source needs to be selected automatically or by a user's instruction. One conventional example of a multifunction peripheral sequentially searches for a sheet feeding tray with the shortest sheet feeding path, and the first found sheet feeding tray storing the desired sheet size is selected.

Another conventional example of a multifunction peripheral selects a sheet feeding tray storing a large quantity of sheets. When there are plural sheet feeding trays storing a large quantity of sheets, the tray with the shortest sheet feeding path among them is selected. When none of the sheet feeding trays stores a large quantity of sheets, the tray with many remaining sheets is selected. When there are plural sheet feeding trays with many remaining sheets, the tray with the shortest sheet feeding path among them is selected (see, for example, Patent Document 1).

Patent Document 1: Japanese Laid-Open Patent Application No. H11-157684

In the conventional technology, the sheet feeding tray is selected according to the number of sheets stored, the number of sheets remaining, or the length of the sheet feeding path, in an attempt to enhance productivity. However, in recent years and continuing, multifunction peripherals are operated under various conditions including sheet types stored in the sheet feeding trays, the machine structure, the machine performance, user options, etc. Therefore, productivity cannot be enhanced sufficiently by simply selecting the sheet feeding tray according to the number of sheets stored, the number of sheets remaining, or the length of the sheet feeding path.

SUMMARY OF THE INVENTION

Accordingly, the present invention may provide an image forming apparatus, a sheet feeding source selection method, and a recording medium in which the above-described disadvantage is eliminated.

A preferred embodiment of the present invention provides an image forming apparatus, a sheet feeding source selection method, and a recording medium that can further enhance productivity by combining various conditions.

An embodiment of the present invention provides an image forming apparatus including a plurality of sheet feeding sources, the image forming apparatus including an acquiring unit configured to acquire a rank for each of the sheet feeding sources from a search order, wherein the search order defines ranks for possible setups of sheet feeding sources, and each of the acquired ranks represents a setup of a sheet feeding source, which setup is available in the image forming apparatus; and a selecting unit configured to select, from among the sheet feeding sources, a sheet feeding source that satisfies a user specification and whose rank is highest.

An embodiment of the present invention provides a sheet feeding source selection method performed by an image forming apparatus including a plurality of sheet feeding sources, the sheet feeding source selection method including the steps of: (a) acquiring a rank for each of the sheet feeding sources from a search order, wherein the search order defines ranks for possible setups of sheet feeding sources, and each of the acquired ranks represents a setup of a sheet feeding source, which setup is available in the image forming apparatus; and (b) selecting, from among the sheet feeding sources, a sheet feeding source that satisfies a user specification and whose rank is highest.

An embodiment of the present invention provides a computer-readable recording medium that stores therein a sheet feeding source selection program that causes an image forming apparatus including a plurality of sheet feeding sources to execute the steps of: (a) acquiring a rank for each of the sheet feeding sources from a search order, wherein the search order defines ranks for possible setups of sheet feeding sources, and each of the acquired ranks represents a setup of a sheet feeding source, which setup is available in the image forming apparatus; and (b) selecting, from among the sheet feeding sources, a sheet feeding source that satisfies a user specification and whose rank is highest.

According to one embodiment of the present invention, an image forming apparatus, a sheet feeding source selection method, and a recording medium that can further enhance productivity by combining various conditions can be provided.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention. A multifunction peripheral (MFP) is taken as an example of an image forming apparatus herein; however, the image forming apparatus can be a printer, a copier, or any other image forming apparatus configured to select a sheet feeding tray from plural sheet feeding trays.

(Apparatus Structure)

Figure 1:
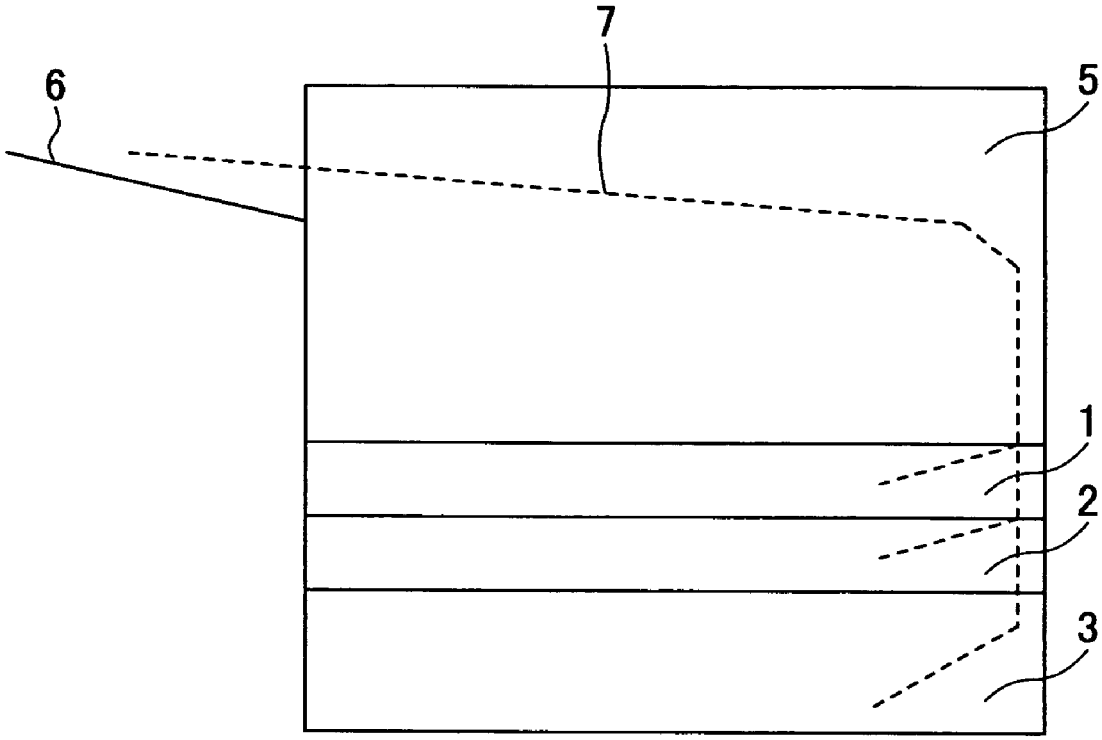
FIG. 1 is a schematic diagram of a multifunction peripheral according to an embodiment of the present invention.

FIG. 1 is a schematic diagram of a multifunction peripheral according to an embodiment of the present invention. The multifunction peripheral shown in FIG. 1 includes sheet feeding trays 1 through 3, an image forming unit 5, a sheet discharge tray 6, and a sheet feeding path 7. The sheet feeding path 7 is a sheet conveying route extended from the sheet feeding trays 1 through 3 to the discharge tray 6. The multifunction peripheral selects a sheet feeding tray from one of the sheet feeding trays 1 through 3, and uses a sheet supplied from the selected sheet feeding tray.

Figure 2:
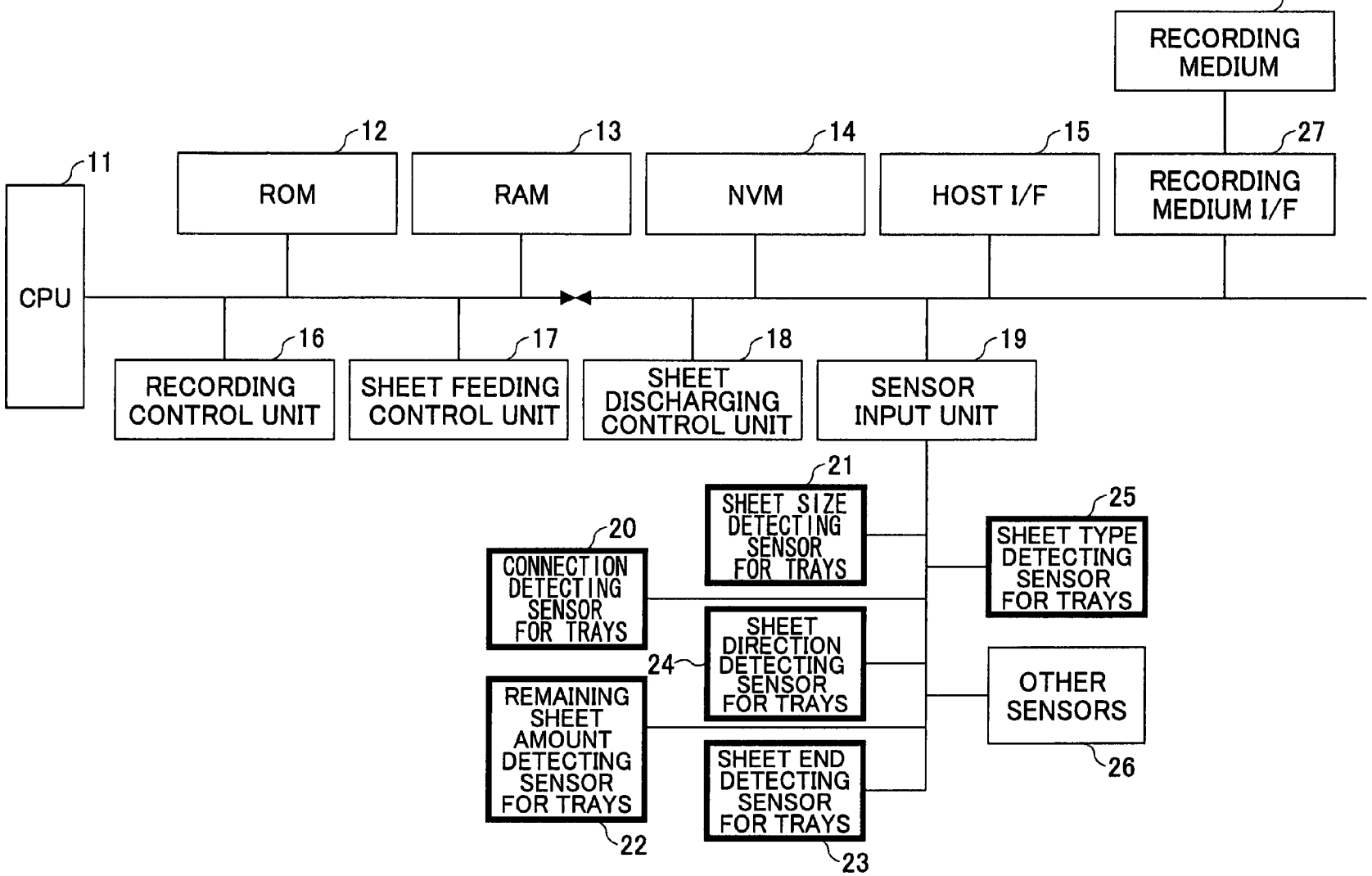
FIG. 2 is an electrical block diagram of the multifunction peripheral according to the embodiment of the present invention.

FIG. 2 is an electrical block diagram of the multifunction peripheral according to the embodiment of the present invention. As shown in FIG. 2, the multifunction peripheral includes a CPU 11, a ROM 12, a RAM 13, a NVM (nonvolatile RAM) 14, a host I/F 15, a recording control unit 16, a sheet feeding control unit 17, a sheet discharging control unit 18, a sensor input unit 19, a connection detecting sensor for the sheet feeding trays (hereinafter, trays) 20, a sheet size detecting sensor for trays 21, a remaining sheet amount detecting sensor for trays 22, a sheet end detecting sensor for trays 23, a sheet direction detecting sensor for trays 24, a sheet type detecting sensor for trays 25, other sensors 26, and a recording medium I/F 27.

The CPU 11 is connected to the ROM 12, the RAM 13, the NVM 14, the host I/F 15, the recording control unit 16, the sheet feeding control unit 17, the sheet discharging control unit 18, the sensor input unit 19, and the recording medium I/F 27.

The host I/F 15 is a communication I/F between a host (or printer controller). The sensor input unit 19 is connected to the connection detecting sensor for trays 20, the sheet size detecting sensor for trays 21, the remaining sheet amount detecting sensor for trays 22, the sheet end detecting sensor for trays 23, the sheet direction detecting sensor for trays 24, the sheet type detecting sensor for trays 25, and the other sensors 26. The sensors connected to the sensor input unit 19 output signals according to conditions of each tray. The CPU 11 recognizes the conditions of each tray based on signals input to the sensor input unit 19, and controls operations of the recording control unit 16, the sheet feeding control unit 17, and the sheet discharging control unit 18 according to a sheet feeding source selection program, thereby controlling the mechanical part of the multifunction peripheral.

The sheet feeding source selection program constitutes at least a part of various programs used for controlling the multifunction peripheral. The sheet feeding source selection program can be, for example, distributed in a recording medium 28, or downloaded from a network. Various types of recording media can be used as the recording medium 28 for recording the sheet feeding source selection program. Examples include: a CD-ROM, a flexible disk, and a magneto-optical disk that electrically or magnetically record information; and semiconductor memories, such as a ROM and a flash memory, which electrically record information.

The sheet feeding source selection program recorded in the recording medium 28 is loaded in the RAM 13, etc., via the recording medium I/F 27. The multifunction peripheral stores necessary files and data together with the sheet feeding source selection program. The sheet feeding source selection program can be previously recorded in the ROM 12. According to the sheet feeding source selection program loaded in the RAM 13, the CPU 11 realizes interpreter software (hereinafter, "interpreter") as shown in FIG. 3.

Figure 3:
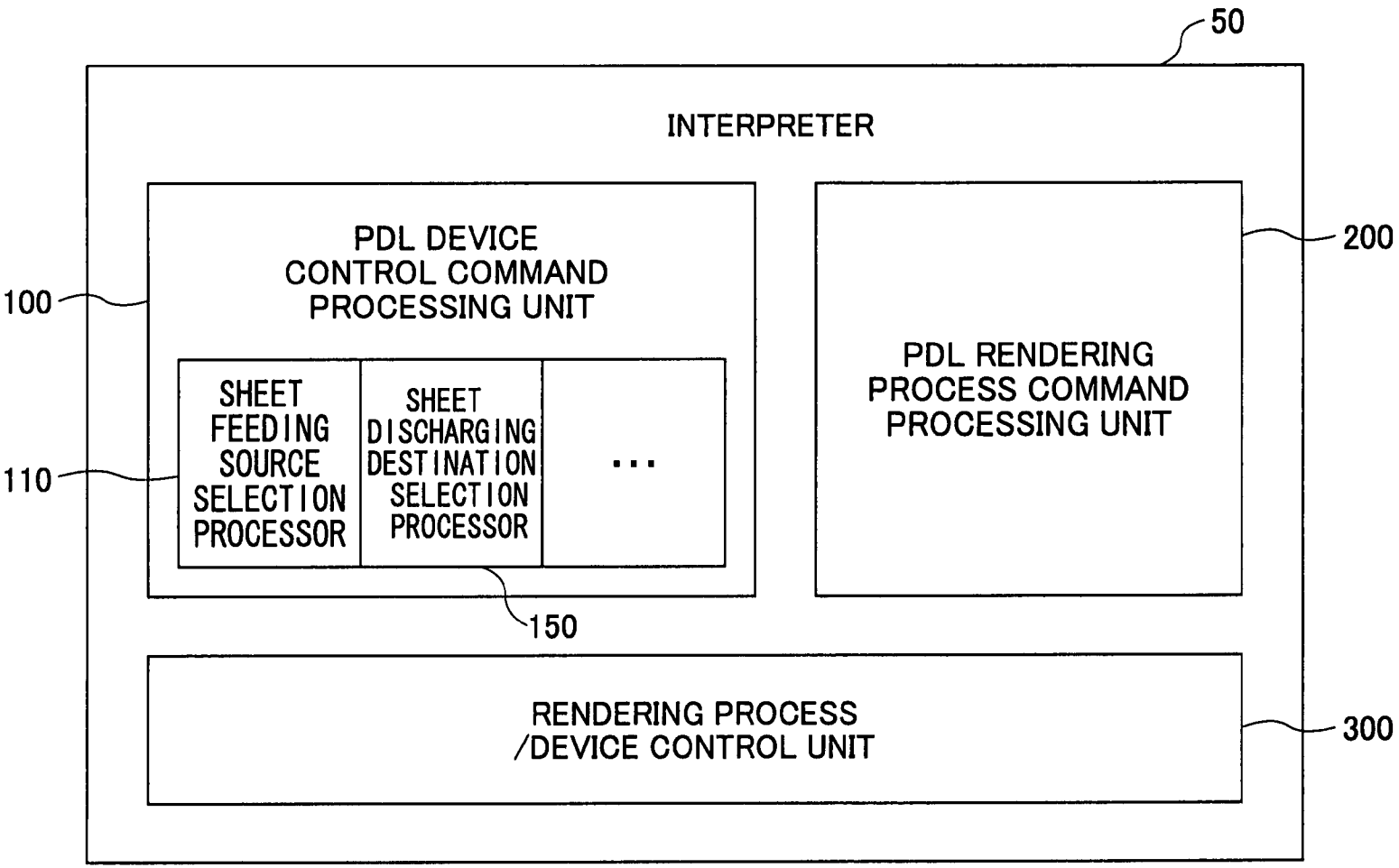
FIG. 3 is a block diagram of one example of an interpreter.

FIG. 3 is a block diagram of one example of the interpreter. An interpreter 50 includes a PDL (page description language) device control command processing unit 100, a PDL rendering process command processing unit 200, and a rendering process/device control unit 300.

The PDL device control command processing unit 100 analyzes and executes device control commands. The PDL device control command processing unit 100 includes a sheet feeding source selection processor 110 and a sheet discharging destination selection processor 150. The PDL rendering process command processing unit 200 analyzes and executes rendering process commands. The rendering process/device control unit 300 performs rendering processes and device control processes.

Figure 4:
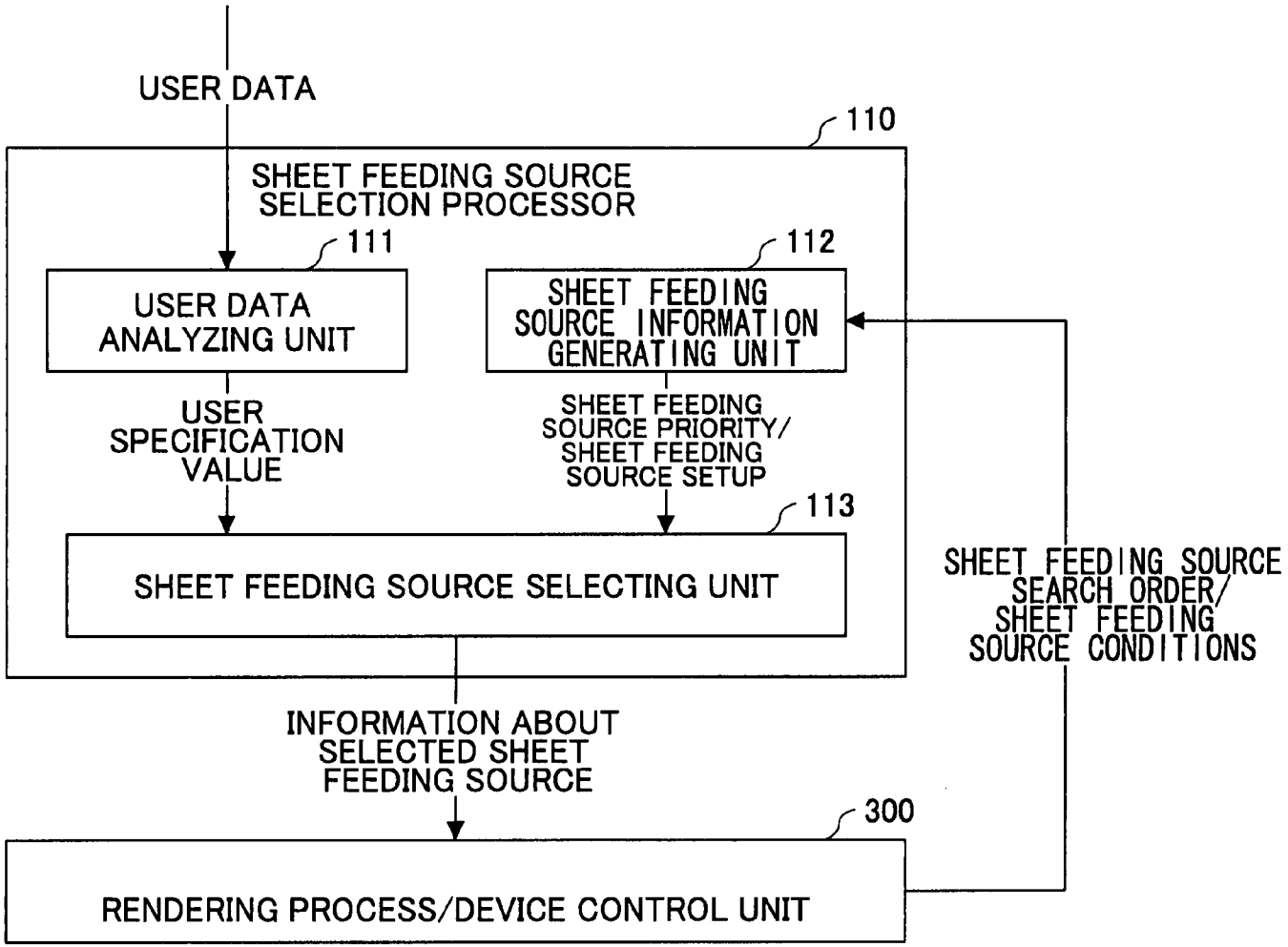
FIG. 4 is a block diagram of one example of a sheet feeding source selection processor.

FIG. 4 is a block diagram of one example of the sheet feeding source selection processor 110. The sheet feeding source selection processor 110 includes a user data analyzing unit 111, a sheet feeding source information generating unit 112, and a sheet feeding source selecting unit 113.

The sheet feeding source selection processor 110 receives user data from a user, and receives the order in which sheet feeding sources are searched (hereinafter, "search order") and sheet feeding source conditions from the rendering process/device control unit 300. The sheet feeding source selection processor 110 selects a sheet feeding source (sheet feeding tray) based on the received user data, the sheet feeding source search order, and sheet feeding source conditions. The sheet feeding source selection processor 110 reports information about the selected sheet feeding source to the rendering process/device control unit 300.

Details of processes performed by the sheet feeding source selection processor 110 are now described. When user data are received, the user data analyzing unit 111 acquires user specifications regarding the sheet feeding source selection from the user data. The user data analyzing unit 111 reports the user specifications as user specification values to the sheet feeding source selecting unit 113. When the sheet feeding source search order/sheet feeding source conditions are received from the rendering process/device control unit 300, the sheet feeding source information generating unit 112 determines setup values regarding the sheet feeding source selection for each sheet feeding source. The sheet feeding source information generating unit 112 reports the setup values as a sheet feeding source priority/sheet feeding source setup to the sheet feeding source selecting unit 113. The sheet feeding source search order is defined for combinations of sheet feeding source names and sheet feeding source setups. The sheet feeding source conditions represent conditions of, for example, available trays installed in the multifunction peripheral.

When the user specification values are received from the user data analyzing unit 111 and the sheet feeding source priority/sheet feeding source setup is received from the sheet feeding source information generating unit 112, the sheet feeding source selecting unit 113 selects a sheet feeding source in accordance with the user specification values. The sheet feeding source selecting unit 113 reports information about the selected sheet feeding source to the rendering process/device control unit 300.

Figure 5:
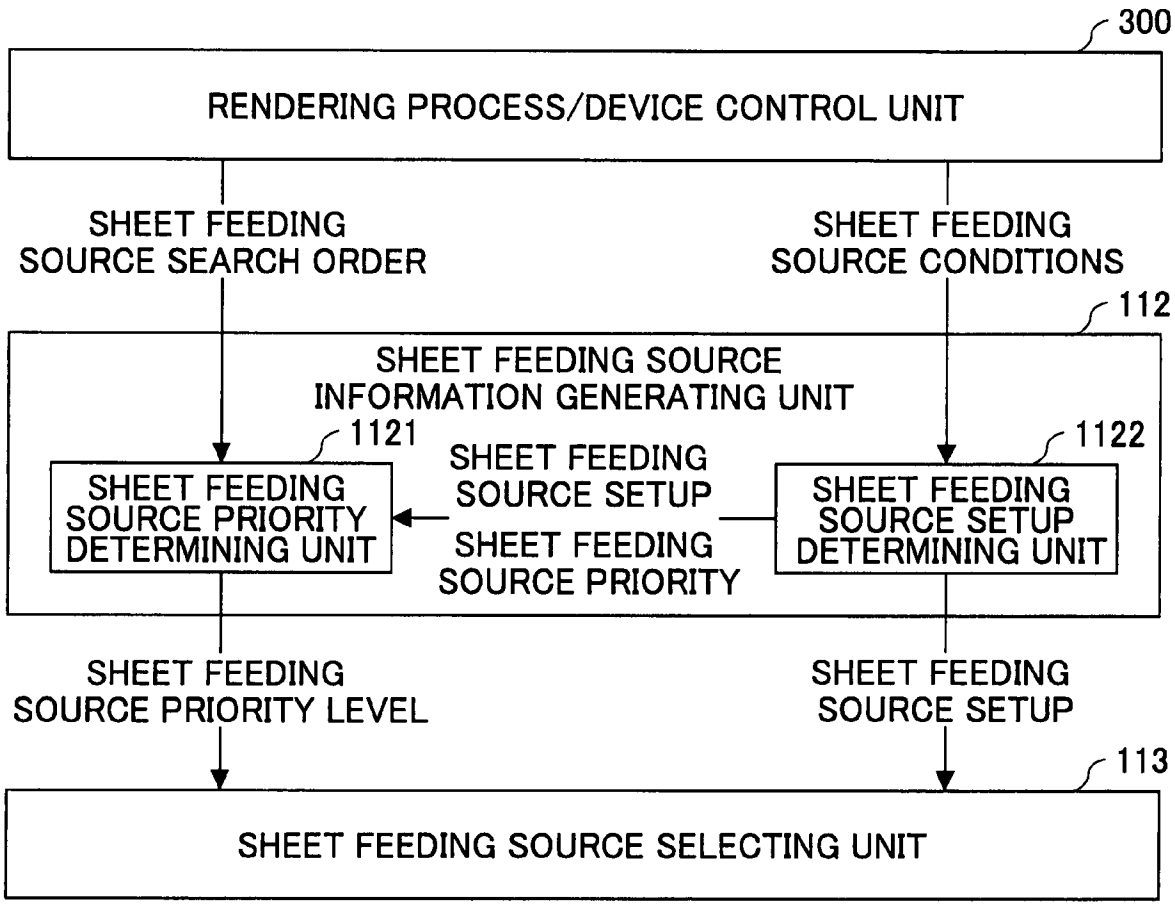
FIG. 5 is a block diagram of one example of a sheet feeding source information generating unit.

FIG. 5 is a block diagram of one example of the sheet feeding source information generating unit 112. The sheet feeding source information generating unit 112 includes a sheet feeding source priority determining unit 1121 and a sheet feeding source setup determining unit 1122. When the sheet feeding source search order is received from the rendering process/device control unit 300, and the sheet feeding source setup and prioritized sheet feeding source are received from the sheet feeding source setup determining unit 1122, the sheet feeding source priority determining unit 1121 determines the sheet feeding source priority levels and reports the sheet feeding source priority levels to the sheet feeding source selecting unit 113. The sheet feeding source setup represents setups necessary for selecting a sheet feeding source.

When sheet feeding source conditions are received from the rendering process/device control unit 300, the sheet feeding source setup determining unit 1122 extracts the prioritized sheet feeding source and the sheet feeding source setup, reports the prioritized sheet feeding source and the sheet feeding source setup to the sheet feeding source priority determining unit 1121, and reports the sheet feeding source setup to the sheet feeding source selecting unit 113.

(Processing Procedures)

Figure 6:
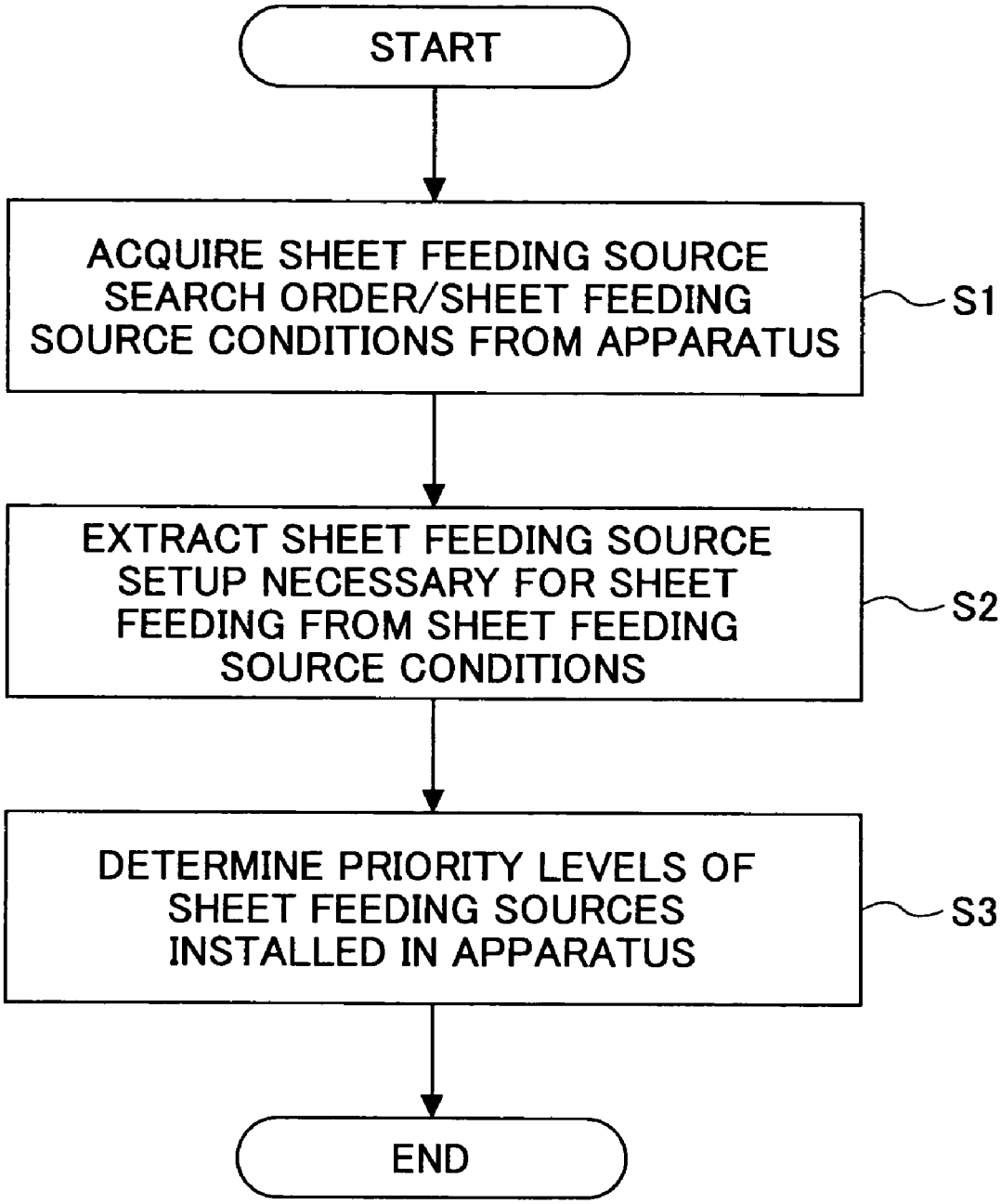
FIG. 6 is a flowchart of one example of a sheet feeding source information generating process.

FIG. 6 is a flowchart of one example of a sheet feeding source information generating process. The sheet feeding source information generating process is executed when the multifunction peripheral is activated or when a job process starts. In step S1, the sheet feeding source selection processor 110 acquires the sheet feeding source search order/sheet feeding source conditions from the rendering process/device control unit 300 as information about the multifunction peripheral itself.

In step S2, the sheet feeding source selection processor 110 extracts information necessary for sheet feeding from the sheet feeding source conditions as a sheet feeding source setup. In step S3, the sheet feeding source selection processor 110 determines priority levels of sheet feeding sources installed in the multifunction peripheral by performing a sheet feeding source priority determining process described in FIG. 7, and the process ends.

Figure 7:
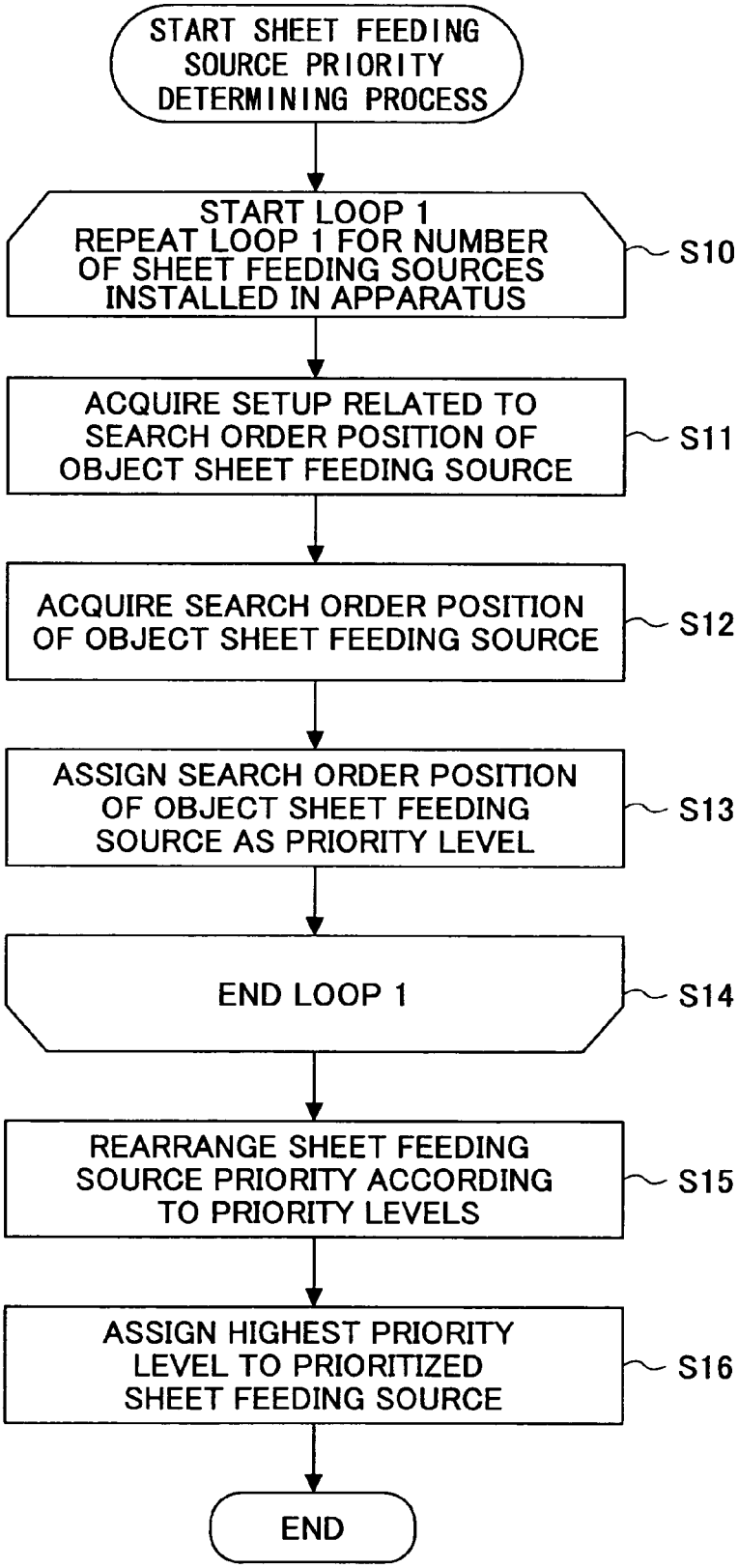
FIG. 7 is a flowchart of one example of a sheet feeding source priority determining process.

FIG. 7 is a flowchart of one example of the sheet feeding source priority determining process. In step S10, the sheet feeding source priority determining unit 1121 starts performing LOOP 1. LOOP 1 is repeated for the number of sheet feeding sources installed in the multifunction peripheral.

In step S11, the sheet feeding source priority determining unit 1121 acquires a setup related to a position of the sheet feeding source that is the object of the process in the search order (hereinafter, "object sheet feeding source"), from the sheet feeding source setups received from the sheet feeding source setup determining unit 1122. In step S12, the sheet feeding source priority determining unit 1121 acquires a position in the sheet feeding source search order received from the rendering process/device control unit 300, which position satisfies the sheet feeding source name of the object sheet feeding source and the setup related to the position of the object sheet feeding source. The acquired position corresponds to the position of the object sheet feeding source in the search order.

In the sheet feeding source search order, all possible combinations of the sheet feeding source name (for example, tray 1) and the setups related to the search order of sheet feeding sources (for example, sheet size, sheet direction, tray type) are sorted by a certain priority, regardless of the conditions of the trays installed in the multifunction peripheral.

In step S13, the sheet feeding source priority determining unit 1121 assigns the position in the search order acquired in step S12 as a priority level of the object sheet feeding source. In step S14, when LOOP 1 has not been repeated for the number of sheet feeding sources installed in the multifunction peripheral, the sheet feeding source priority determining unit 1121 repeats LOOP 1. On the other hand, when LOOP 1 has been repeated for the number of sheet feeding sources installed in the multifunction peripheral, the sheet feeding source priority determining unit 1121 ends LOOP 1. When LOOP 1 is ended, the priority levels are set in the sheet feeding sources installed in the multifunction peripheral.

In step S15, the sheet feeding source priority determining unit 1121 rearranges the sheet feeding source priorities according to the priority levels obtained in LOOP 1. In step S16, when a prioritized sheet feeding source has been received from the sheet feeding source setup determining unit 1122, the sheet feeding source priority determining unit 1121 places the highest priority on the corresponding sheet feeding source, rearranges the sheet feeding source priorities again, and ends the process.

Figure 8:
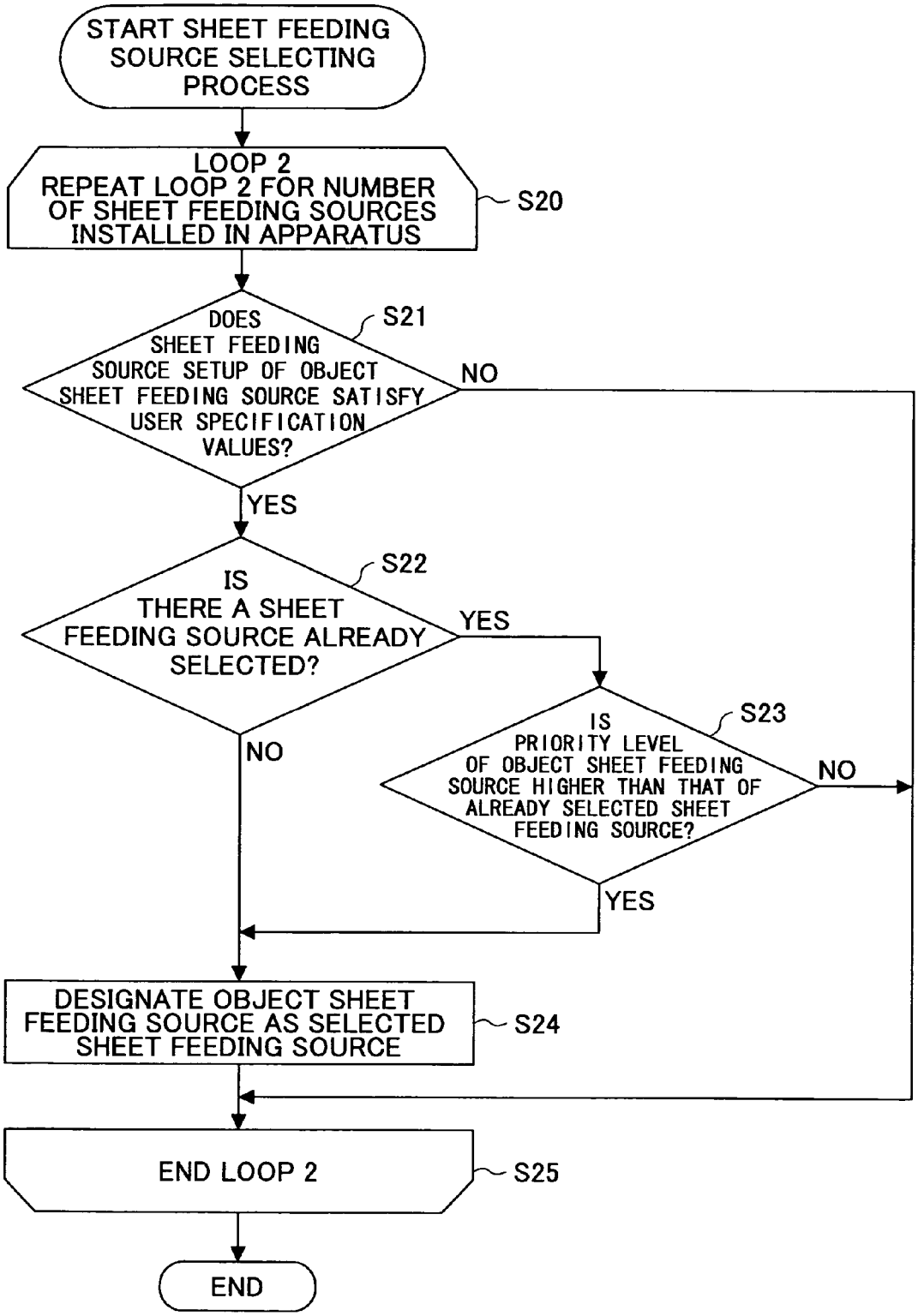
FIG. 8 is a flowchart of one example of a sheet feeding source selecting process.

FIG. 8 is a flowchart of one example of a sheet feeding source selecting process. In step S20, the sheet feeding source selecting unit 113 starts performing LOOP 2. LOOP 2 is repeated for the number of sheet feeding sources installed in the multifunction peripheral.

In step S21, the sheet feeding source selecting unit 113 acquires a sheet feeding source setup of the object sheet feeding source from among the sheet feeding source setups received from the sheet feeding source information generating unit 112. The sheet feeding source selecting unit 113 determines whether the sheet feeding source setup of the object sheet feeding source satisfies the user specification values received from the user data analyzing unit 111.

When it is determined that the user specification values are satisfied, the process proceeds to step S22, and the sheet feeding source selecting unit 113 determines whether a sheet feeding source is already selected. When a sheet feeding source is not selected, the process proceeds to step S24, and the sheet feeding source selecting unit 113 designates the object sheet feeding source as the selected sheet feeding source. On the other hand, when a sheet feeding source is already selected, the process proceeds to step S23, and the sheet feeding source selecting unit 113 determines whether the priority level of the object sheet feeding source is higher than that of the already selected sheet feeding source.

When the priority level of the object sheet feeding source is higher than that of the already selected sheet feeding source, the process proceeds to step S24, and the sheet feeding source selecting unit 113 designates the object sheet feeding source as the selected sheet feeding source. When the priority level of the object sheet feeding source is not higher than that of the already selected sheet feeding source, the process proceeds to step S25. Also, when it is determined that the user specification values are not satisfied in step S21, the process proceeds to step S25.

In step S25, the sheet feeding source selecting unit 113 determines whether LOOP 2 has been repeated for the number of sheet feeding sources installed in the multifunction peripheral. When LOOP 2 has not been repeated for the number of sheet feeding sources installed in the multifunction peripheral, the sheet feeding source selecting unit 113 repeats LOOP 2. On the other hand, when LOOP 2 has been repeated for the number of sheet feeding sources installed in the multifunction peripheral, the sheet feeding source selecting unit 113 ends LOOP 2. The sheet feeding source selected when LOOP 2 is ended becomes the result of the sheet feeding source selecting process. The sheet feeding source selecting unit 113 reports the sheet feeding source selected as the result of the sheet feeding source selecting process to the rendering process/device control unit 300 as sheet feeding source information.

The multifunction peripheral according to an embodiment of the present invention searches a sheet feeding source by the sheet feeding source selecting process; and therefore, a sheet feeding source of high productivity can be selected according to various conditions. Moreover, the sheet feeding source search order is managed by the rendering process/device control unit 300 in the multifunction peripheral; and therefore, even if contents of the sheet feeding source search order change, the sheet feeding source information generating unit 112 can appropriately generate information from the search order.

First Embodiment

Figure 9:
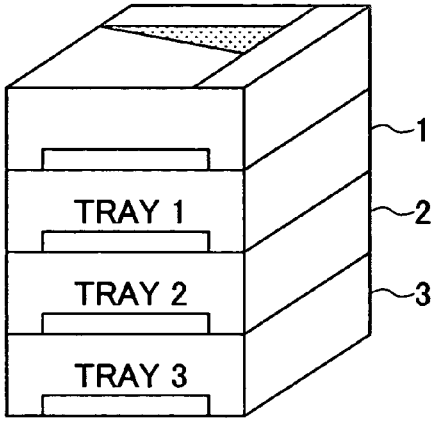
FIG. 9 is a perspective view of a multifunction peripheral according to a first embodiment of the present invention.

FIG. 9 is a perspective view of a multifunction peripheral according to a first embodiment of the present invention. The multifunction peripheral shown in FIG. 9 includes three trays named with sheet feeding source names tray 1, tray 2, and tray 3. Tray 1 stores A4 sized, plain paper sheets positioned in a sheet direction of SEF (short edge feed); tray 2 stores A3 sized, cardboard sheets positioned in a sheet direction of SEF; and tray 3 stores A4 sized, plain paper sheets positioned in a sheet direction of LEF (long edge feed). The prioritized (highest priority) sheet feeding source is tray 2. The sheet feeding source names and sheet feeding source setups of trays 1 through 3 are shown in Table 1. The sheet feeding source search order is shown in Table 2.

TABLE 1

| Sheet feeding source name | Sheet feeding source setup |
|---|---|
| Tray 1 | A4 SEF Plain paper |
| Tray 2 | A3 SEF Cardboard paper |
| Tray 3 | A4 LEF Plain paper |

TABLE 2

| Search order | Sheet feeding source setup |
|---|---|
| 1 | Tray 1 LEF |
| 2 | Tray 2 LEF |
| 3 | Tray 3 LEF |
| 4 | Tray 1 SEF |
| 5 | Tray 2 SEF |
| 6 | Tray 3 SEF |

Figure 10:
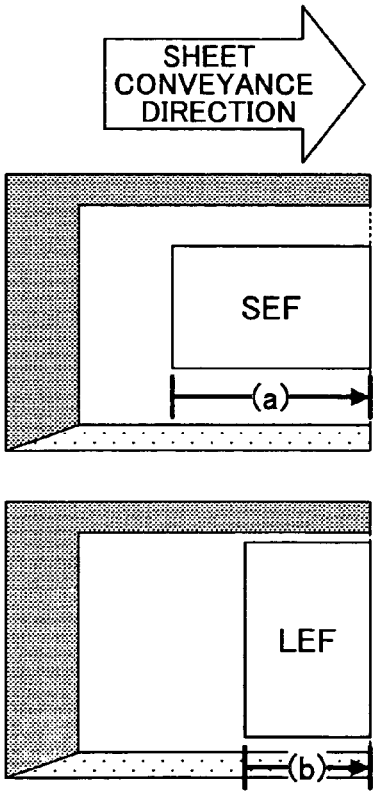
FIG. 10 describes lengths of sheet conveyance.

In the sheet feeding source search order, the trays are sorted by ascending order of the length of sheet conveyance for each tray. The length of sheet conveyance corresponds to the side of the sheet along the sheet feeding direction. FIG. 10 describes the length of sheet conveyance. The top diagram in FIG. 10 is an example of an SEF (short edge feed) sheet direction. The bottom diagram in FIG. 10 is an example of an LEF (long edge feed) sheet direction.

When the sheet direction is SEF, the length of sheet conveyance corresponds to a length (a) of the sheet shown in FIG. 10. When the sheet direction is LEF, the length of sheet conveyance corresponds to a length (b) of the sheet shown in FIG. 10. In the sheet feeding source search order shown in Table 2, setups in which the length of sheet conveyance is short are prioritized in order to enhance productivity.

(Processing Procedures)

A sheet feeding source priority determining process according to the first embodiment is described with reference to FIG. 7.

In step S10, the sheet feeding source priority determining unit 1121 starts performing LOOP 1, which is repeated for the number of sheet feeding sources installed in the multifunction peripheral.

In step S11, the sheet feeding source priority determining unit 1121 acquires the sheet direction "SEF" of tray 1 from Table 1 as a setup related to a position of the object sheet feeding source, from among the sheet feeding source setups received from the sheet feeding source setup determining unit 1122. In step S12, the sheet feeding source priority determining unit 1121 acquires the position "4" in the search order shown in Table 2, which position satisfies the sheet feeding source name "tray 1" and the setup related to the position of the object sheet feeding source "SEF". The acquired position "4" is set as the position of tray 1 in the search order. In step S13, the sheet feeding source priority determining unit 1121 assigns the position "4" in the search order for tray 1 as a priority level of tray 1.

In step S14, LOOP 1 has not been repeated for the number of sheet feeding sources installed in the multifunction peripheral; and therefore, the process returns to step S11. The sheet feeding source priority determining unit 1121 acquires the sheet direction "SEF" of tray 2 from Table 1 as a setup related to a position of the object sheet feeding source, from among the sheet feeding source setups received from the sheet feeding source setup determining unit 1122. In step S12, the sheet feeding source priority determining unit 1121 acquires the position "5" in the search order shown in Table 2, which position satisfies the sheet feeding source name "tray 2" and the setup related to the position of the object sheet feeding source "SEF". The acquired position "5" is set as the position of tray 2 in the search order. In step S13, the sheet feeding source priority determining unit 1121 assigns the position "5" in the search order for tray 2 as a priority level of tray 2.

In step S14, LOOP 1 has not been repeated for the number of sheet feeding sources installed in the multifunction peripheral; and therefore, the process returns to step S11. The sheet feeding source priority determining unit 1121 acquires the sheet direction "LEF" of tray 3 from Table 1 as a setup related to a position of the object sheet feeding source, from among the sheet feeding source setups received from the sheet feeding source setup determining unit 1122. In step S12, the sheet feeding source priority determining unit 1121 acquires the position "3" in the search order shown in Table 2, which position satisfies the sheet feeding source name "tray 3" and the setup related to the position of the object sheet feeding source "LEF". The acquired position "3" is set as the position of tray 3 in the search order. In step S13, the sheet feeding source priority determining unit 1121 assigns the position "3" in the search order for tray 3 as a priority level of tray 3.

In step S14, LOOP 1 has been repeated for the number of sheet feeding sources installed in the multifunction peripheral; and therefore, the sheet feeding source priority determining unit 1121 ends LOOP 1. In step S15, the sheet feeding source priority determining unit 1121 rearranges the sheet feeding source priorities according to the priority levels obtained in LOOP 1. The sheet feeding source priorities rearranged according to the priority levels are shown in Table 3.

TABLE 3

| Priority level | Sheet feeding source |
|---|---|
| 3 | Tray 3 |
| 4 | Tray 1 |
| 5 | Tray 2 |

In step S16, the sheet feeding source priority determining unit 1121 places the highest priority on tray 2, which is the prioritized sheet feeding source, and rearranges the sheet feeding source priorities again. The sheet feeding source priorities rearranged with the highest priority placed on tray 2, which is the prioritized sheet feeding source, is shown in Table 4.

TABLE 4

| Priority level | Sheet feeding source |
|---|---|
| 5 | Tray 2 |
| 3 | Tray 3 |
| 4 | Tray 1 |

The sheet feeding source priority determining unit 1121 renumbers the rearranged sheet feeding source priority levels, starting with 1. The renumbered sheet feeding source priorities are shown in Table 5.

TABLE 5

| Priority level | Sheet feeding source |
|---|---|
| 1 | Tray 2 |
| 2 | Tray 3 |
| 3 | Tray 1 |

As described above, the sheet feeding source priority determining unit 1121 determines the sheet feeding source priority levels, and reports the sheet feeding source priority levels to the sheet feeding source selecting unit 113. A sheet feeding source selecting process according to the first embodiment is described with reference to FIG. 8.

In step S20, the sheet feeding source selecting unit 113 starts performing LOOP 2, which is repeated for the number of sheet feeding sources installed in the multifunction peripheral. In step S21, it is assumed that the user specification values received from the user data analyzing unit 111 indicate that the sheet size is "A4" and the paper type is "plain paper". The sheet feeding source selecting unit 113 acquires the sheet size "A4" and the paper type "plain paper" of tray 1 from Table 1, from among the sheet feeding source setups received from the sheet feeding source information generating unit 112.

As the sheet size "A4" and the paper type "plain paper" of tray 1 satisfy the user specification values received from the user data analyzing unit 111, the process proceeds to step S22, and the sheet feeding source selecting unit 113 determines whether a sheet feeding source is already selected. In this case, there is no sheet feeding source selected; therefore, the process proceeds to step S24, and the sheet feeding source selecting unit 113 designates tray 1 as the sheet feeding source.

In step S25, LOOP 2 has not been repeated for the number of sheet feeding sources installed in the multifunction peripheral; and therefore, the process returns to step S21. The sheet feeding source selecting unit 113 acquires the sheet size "A3" and the paper type "cardboard" of tray 2 from Table 1, from among the sheet feeding source setups received from the sheet feeding source information generating unit 112.

As the sheet size "A3" and the paper type "cardboard" of tray 2 do not satisfy the user specification values received from the user data analyzing unit 111, the process proceeds to step S25. In step S25, LOOP 2 has not been repeated for the number of sheet feeding sources installed in the multifunction peripheral; and therefore, the process returns to step S21. The sheet feeding source selecting unit 113 acquires the sheet size "A4" and the paper type "plain paper" of tray 3 from Table 1, from among the sheet feeding source setups received from the sheet feeding source information generating unit 112.

As the sheet size "A4" and the paper type "plain paper" of tray 3 satisfy the user specification values received from the user data analyzing unit 111, the process proceeds to step S22, and the sheet feeding source selecting unit 113 determines whether a sheet feeding source is already selected. In this case, there is a sheet feeding source selected; and therefore, the process proceeds to step S23. In step S23, the sheet feeding source selecting unit 113 determines whether the priority level "2" of tray 3, which is the object sheet feeding source, is higher than the priority level "3" of tray 1, which is the sheet feeding source already selected.

Because the priority level of tray 3 is higher than the priority level of tray 1, the process proceeds to step S24, and the sheet feeding source selecting unit 113 designates tray 3 as the selected sheet feeding source. The process proceeds to step S25, and LOOP 2 has been repeated for the number of sheet feeding sources installed in the multifunction peripheral; and therefore, the sheet feeding source selecting unit 113 ends LOOP 2.

Tray 3, which is the selected sheet feeding source when LOOP 2 is ended, becomes the result of the sheet feeding source selecting process. The sheet feeding source selecting unit 113 reports tray 3, which is the sheet feeding source selected as the result of the sheet feeding source selecting process, to the rendering process/device control unit 300 as sheet feeding source information.

The multifunction peripheral according to the first embodiment can select the sheet feeding source that satisfies the user's specification and that has the shortest length of sheet conveyance.

Second Embodiment

Figure 11:
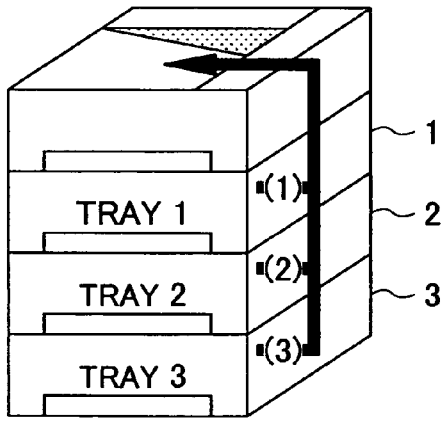
FIG. 11 is a perspective view of a multifunction peripheral according to a second embodiment of the present invention.

FIG. 11 is a perspective view of a multifunction peripheral according to a second embodiment of the present invention. The multifunction peripheral shown in FIG. 11 includes three trays named with sheet feeding source names tray 1, tray 2, and tray 3. The arrow in FIG. 11 indicates a sheet feeding path for trays 1 through 3.

Tray 1 stores Letter sized, plain paper sheets positioned in a sheet direction of LEF; tray 2 stores A3 sized, plain paper sheets positioned in a sheet direction of SEF; and tray 3 stores A4 sized, plain paper sheets positioned in a sheet direction of LEF. Tray 2 is the prioritized sheet feeding source. The sheet feeding source names and the sheet feeding source setups are shown in FIG. 6. The sheet feeding source search order is shown in Table 7.

TABLE 6

| Sheet feeding source name | Sheet feeding source setup |
|---|---|
| Tray 1 | Letter LEF Plain paper |
| Tray 2 | A3 SEF Plain paper |
| Tray 3 | A4 LEF Plain paper |

TABLE 7

| Search order | Sheet feeding source setup |
|---|---|
| 1 | Tray 1 A4 |
| 2 | Tray 2 A4 |
| 3 | Tray 3 A4 |
| 4 | Tray 1 Other sheet size |
| 5 | Tray 2 Other sheet size |
| 6 | Tray 3 Other sheet size |

In the sheet feeding source search order own in Table 7, the sheet feeding sources are sorted by ascending order of the length of sheet feeding path. In the sheet feeding source search order shown in Table 7, setups in which the sheet size is A4 and the sheet feeding path is short are prioritized higher in order to enhance productivity.

(Processing Procedures)

A sheet feeding source priority determining process according to the second embodiment is described with reference to FIG. 7.

In step S10, the sheet feeding source priority determining unit 1121 starts performing LOOP 1, which is repeated for the number of sheet feeding sources installed in the multifunction peripheral.

In step S11, the sheet feeding source priority determining unit 1121 acquires the sheet size "Letter" of tray 1 from Table 6 as a setup related to a position of the object sheet feeding source, from among the sheet feeding source setups received from the sheet feeding source setup determining unit 1122. In step S12, the sheet feeding source priority determining unit 1121 acquires the position "4" in the search order shown in Table 7, which position satisfies the sheet feeding source name "tray 1" and the setup related to the position of the object sheet feeding source "Letter". The acquired position "4" is set as the position of tray 1 in the search order. In step S13, the sheet feeding source priority determining unit 1121 assigns the position "4" in the search order for tray 1 as a priority level of tray 1.

In step S14, LOOP 1 has not been repeated for the number of sheet feeding sources installed in the multifunction peripheral; and therefore, the process returns to step S11. The sheet feeding source priority determining unit 1121 acquires the sheet size "A3" of tray 2 from Table 6 as a setup related to a position of the object sheet feeding source, from among the sheet feeding source setups received from the sheet feeding source setup determining unit 1122. In step S12, the sheet feeding source priority determining unit 1121 acquires the position "5" in the search order shown in Table 7, which position satisfies the sheet feeding source name "tray 2" and the setup related to the position of the object sheet feeding source "A3". The acquired position "5" is set as the position of tray 2 in the search order. In step S13, the sheet feeding source priority determining unit 1121 assigns the position "5" in the search order for tray 2 as a priority level of tray 2.

In step S14, LOOP 1 has not been repeated for the number of sheet feeding sources installed in the multifunction peripheral; and therefore, the process returns to step S11. The sheet feeding source priority determining unit 1121 acquires the sheet size "A4" of tray 3 from Table 6 as a setup related to a position of the object sheet feeding source, from among the sheet feeding source setups received from the sheet feeding source setup determining unit 1122. In step S12, the sheet feeding source priority determining unit 1121 acquires the position "3" in the search order shown in Table 7, which position satisfies the sheet feeding source name "tray 3" and the setup related to the position of the object sheet feeding source "A4". The acquired position "3" is set as the position of tray 3 in the search order. In step S13, the sheet feeding source priority determining unit 1121 assigns the position "3" in the search order for tray 3 as a priority level of tray 3.

In step S14, LOOP 1 has been repeated for the number of sheet feeding sources installed in the multifunction peripheral; and therefore, the sheet feeding source priority determining unit 1121 ends LOOP 1. In step S15, the sheet feeding source priority determining unit 1121 rearranges the sheet feeding source priorities according to the priority levels obtained in LOOP 1. The sheet feeding source priorities rearranged according to the priority levels are shown in Table 8.

TABLE 8

| Priority level | Sheet feeding source |
|---|---|
| 3 | Tray 3 |
| 4 | Tray 1 |
| 5 | Tray 2 |

In step S16, the sheet feeding source priority determining unit 1121 places the highest priority on tray 2, which is the prioritized sheet feeding source, and rearranges the sheet feeding source priorities again. The sheet feeding source priorities rearranged with the highest priority placed on tray 2, which is the prioritized sheet feeding source, are shown in Table 9.

TABLE 9

| Priority level | Sheet feeding source |
|---|---|
| 5 | Tray 2 |
| 3 | Tray 3 |
| 4 | Tray 1 |

The sheet feeding source priority determining unit 1121 renumbers the rearranged sheet feeding source priority levels, starting with 1. The renumbered sheet feeding source priorities are shown in Table 10.

TABLE 10

| Priority level | Sheet feeding source |
|---|---|
| 1 | Tray 2 |
| 2 | Tray 3 |
| 3 | Tray 1 |

As described above, the sheet feeding source priority determining unit 1121 determines the sheet feeding source priorities, and reports the sheet feeding source priorities to the sheet feeding source selecting unit 113. A sheet feeding source selecting process according to the second embodiment is described with reference to FIG. 8.

In step S20, the sheet feeding source selecting unit 113 starts performing LOOP 2, which is repeated for the number of sheet feeding sources installed in the multifunction peripheral. In step S21, it is assumed that the user specification values received from the user data analyzing unit 111 indicate that the sheet size is "A4" and the paper type is "plain paper". The sheet feeding source selecting unit 113 acquires the sheet size "Letter" and the paper type "plain paper" of tray 1 from Table 6, from among the sheet feeding source setups received from the sheet feeding source information generating unit 112.

As the sheet size "Letter" and the paper type "plain paper" of tray 1 do not satisfy the user specification values received from the user data analyzing unit 111, the process proceeds to step S25. In step S25, LOOP 2 has not been repeated for the number of sheet feeding sources installed in the multifunction peripheral; and therefore, the process returns to step S21. The sheet feeding source selecting unit 113 acquires the sheet size "A3" and the paper type "plain paper" of tray 2 from Table 6, from among the sheet feeding source setups received from the sheet feeding source information generating unit 112.

As the sheet size "A3" and the paper type "plain paper" of tray 2 do not satisfy the user specification values received from the user data analyzing unit 111, the process proceeds to step S25. In step S25, LOOP 2 has not been repeated for the number of sheet feeding sources installed in the multifunction peripheral; and therefore, the process returns to step S21. The sheet feeding source selecting unit 113 acquires the sheet size "A4" and the paper type "plain paper" of tray 3 from Table 6, from among the sheet feeding source setups received from the sheet feeding source information generating unit 112.

As the sheet size "A4" and the paper type "plain paper" of tray 3 satisfy the user specification values received from the user data analyzing unit 111, the process proceeds to step S22, and the sheet feeding source selecting unit 113 determines whether a sheet feeding source is already selected. In this case, there is no sheet feeding source selected; therefore, the process proceeds to step S24, and the sheet feeding source selecting unit 113 designates tray 3 as the sheet feeding source. The process proceeds to step S25, and LOOP 2 has been repeated for the number of sheet feeding sources installed in the multifunction peripheral; and therefore, the sheet feeding source selecting unit 113 ends LOOP 2.

Tray 3, which is the selected sheet feeding source when LOOP 2 is ended, becomes the result of the sheet feeding source selecting process. The sheet feeding source selecting unit 113 reports tray 3, which is the sheet feeding source selected as the result of the sheet feeding source selecting process, to the rendering process/device control unit 300 as sheet feeding source information.

The multifunction peripheral according to the second embodiment can select the sheet feeding source that satisfies the user's specification and that has the shortest sheet feeding path.

Third Embodiment

Figure 12:
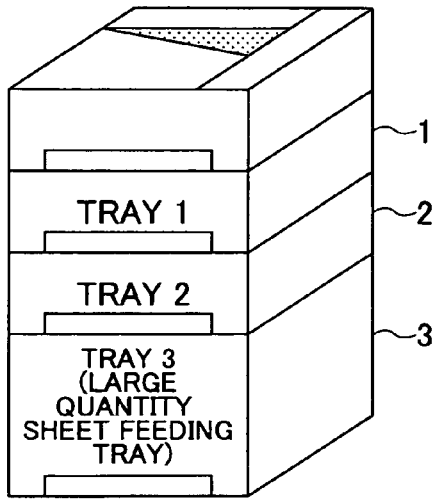
FIG. 12 is a perspective view of a multifunction peripheral according to a third embodiment of the present invention.

FIG. 12 is a perspective view of a multifunction peripheral according to a third embodiment of the present invention. The multifunction peripheral shown in FIG. 12 includes three trays named with sheet feeding source names tray 1, tray 2, and tray 3. Tray 3 can store a large quantity of sheets. Tray 1 stores Letter sized plain paper sheets; tray 2 stores A4 sized plain paper sheets; and tray 3 stores A4 sized plain paper sheets. Tray 1 is the prioritized sheet feeding source. The sheet feeding source names and the sheet feeding source setups are shown in FIG. 11. The sheet feeding source search order is shown in Table 12.

TABLE 11

| Sheet feeding source name | Sheet feeding source setup |
|---|---|
| Tray 1 | Letter Plain paper |
| Tray 2 | A4 Plain paper |
| Tray 3 | A4 Plain paper |

TABLE 12

| Search order | Sheet feeding source setup |
|---|---|
| 1 | Tray 3 (large quantity sheet feeding tray) |
| 2 | Tray 1 |
| 3 | Tray 2 |
| 4 | Tray 3 |

In the sheet feeding source search order shown in Table 12, a setup including the large quantity sheet feeding tray is prioritized in order to enhance productivity.

(Processing Procedures)

A sheet feeding source priority determining process according to the third embodiment is described with reference to FIG. 7. In step S10, the sheet feeding source priority determining unit 1121 starts performing LOOP 1, which is repeated for the number of sheet feeding sources installed in the multifunction peripheral. In steps S11, S12, the priority determining unit 1121 acquires the position "2" of tray 1 in the search order shown in Table 12, and sets "2" as the position of tray 1 in the search order. In step S13, the priority determining unit 1121 assigns the position "2" in the search order for tray 1 as a priority level of tray 1.

In step S14, LOOP 1 has not been repeated for the number of sheet feeding sources installed in the multifunction peripheral; and therefore, the process returns to steps S11, S12. The priority determining unit 1121 acquires the position "3" of tray 2 in the search order shown in Table 12, and sets "3" as the position of tray 2 in the search order. In step S13, the priority determining unit 1121 assigns the position "3" in the search order for tray 2 as a priority level of tray 2.

In step S14, LOOP 1 has not been repeated for the number of sheet feeding sources installed in the multifunction peripheral; and therefore, the process returns to step S11. The sheet feeding source priority determining unit 1121 acquires information as to whether tray 3 is a large quantity sheet feeding tray from Table 11 as a setup related to a position of the object sheet feeding source, from among the sheet feeding source setups received from the sheet feeding source setup determining unit 1122. In step S12, the sheet feeding source priority determining unit 1121 acquires the position "1" in the search order shown in Table 12, which position satisfies the sheet feeding source name "tray 3" and the setup related to the position of the object sheet feeding source "large quantity sheet feeding tray". The acquired position "1" is set as the position of tray 3 in the search order. In step S13, the sheet feeding source priority determining unit 1121 assigns the position "1" in the search order for tray 3 as a priority level of tray 3.

In step S14, LOOP 1 has been repeated for the number of sheet feeding sources installed in the multifunction peripheral; and therefore, the sheet feeding source priority determining unit 1121 ends LOOP 1. In step S15, the sheet feeding source priority determining unit 1121 rearranges the sheet feeding source priorities according to the priority levels obtained in LOOP 1. The sheet feeding source priorities rearranged according to the priority levels are shown in Table 13.

TABLE 13

| Priority level | Sheet feeding source |
|---|---|
| 1 | Tray 3 |
| 2 | Tray 1 |
| 3 | Tray 2 |

In step S16, the sheet feeding source priority determining unit 1121 places the highest priority on tray 1, which is the prioritized sheet feeding source, and rearranges the sheet feeding source priorities again. The sheet feeding source priority rearranged with the highest priority placed on tray 1, which is the prioritized sheet feeding source, are shown in Table 14.

TABLE 14

| Priority level | Sheet feeding source |
|---|---|
| 2 | Tray 1 |
| 1 | Tray 3 |
| 3 | Tray 2 |

The sheet feeding source priority determining unit 1121 renumbers the rearranged sheet feeding source priority levels, starting with 1. The renumbered sheet feeding source priorities are shown in Table 15.

TABLE 15

| Priority level | Sheet feeding source |
|---|---|
| 1 | Tray 1 |
| 2 | Tray 3 |
| 3 | Tray 2 |

As described above, the sheet feeding source priority determining unit 1121 determines the sheet feeding source priority, and reports the sheet feeding source priority to the sheet feeding source selecting unit 113. A sheet feeding source selecting process according to the third embodiment is described with reference to FIG. 8.

In step S20, the sheet feeding source selecting unit 113 starts performing LOOP 2, which is repeated for the number of sheet feeding sources installed in the multifunction peripheral. In step S21, it is assumed that the user specification values received from the user data analyzing unit 111 indicate that the sheet size is "A4" and the paper type is "plain paper". The sheet feeding source selecting unit 113 acquires the sheet size "Letter" and the paper type "plain paper" of tray 1 from Table 11, from among the sheet feeding source setups received from the sheet feeding source information generating unit 112.

As the sheet size "Letter" and the paper type "plain paper" of tray 1 do not satisfy the user specification values received from the user data analyzing unit 111, the process proceeds to step S25. In step S25, LOOP 2 has not been repeated for the number of sheet feeding sources installed in the multifunction peripheral; and therefore, the process returns to step S21. The sheet feeding source selecting unit 113 acquires the sheet size "A4" and the paper type "plain paper" of tray 2 from Table 11, from among the sheet feeding source setups received from the sheet feeding source information generating unit 112.

As the sheet size "A4" and the paper type "plain paper" of tray 2 satisfy the user specification values received from the user data analyzing unit 111, the process proceeds to step S22, and the sheet feeding source selecting unit 113 determines whether a sheet feeding source is already selected. In this case, there is no sheet feeding source selected; therefore, the process proceeds to step S24, and the sheet feeding source selecting unit 113 designates tray 2 as the sheet feeding source.

In step S25, LOOP 2 has not been repeated for the number of sheet feeding sources installed in the multifunction peripheral; and therefore, the process returns to step S21. The sheet feeding source selecting unit 113 acquires the sheet size "A4" and the paper type "plain paper" of tray 3 from Table 11, from among the sheet feeding source setups received from the sheet feeding source information generating unit 112.

As the sheet size "A4" and the paper type "plain paper" of tray 3 satisfy the user specification values received from the user data analyzing unit 111, the process proceeds to step S22, and the sheet feeding source selecting unit 113 determines whether a sheet feeding source is already selected. In this case, there is a sheet feeding source selected; and therefore, the process proceeds to step S23. In step S23, the sheet feeding source selecting unit 113 determines whether the priority level "2" of tray 3, which is the object sheet feeding source, is higher than the priority level "3" of tray 2, which is the sheet feeding source already selected.

Because the priority level of tray 3 is higher than the priority level of tray 2, the process proceeds to step S24, and the sheet feeding source selecting unit 113 designates tray 3 as the selected sheet feeding source. The process proceeds to step S25, and LOOP 2 has been repeated for the number of sheet feeding sources installed in the multifunction peripheral; and therefore, the sheet feeding source selecting unit 113 ends LOOP 2.

Tray 3, which is the selected sheet feeding source when LOOP 2 is ended, becomes the result of the sheet feeding source selecting process. The sheet feeding source selecting unit 113 reports tray 3, which is the sheet feeding source selected as the result of the sheet feeding source selecting process, to the rendering process/device control unit 300 as sheet feeding source information.

The multifunction peripheral according to the third embodiment can select the sheet feeding source that satisfies the user's specification and that is the large quantity sheet feeding tray.

The present invention is not limited to the specifically disclosed embodiment, and variations and modifications may be made without departing from the scope of the present invention.

The present application is based on Japanese Priority Patent Application No. 2005-265854, filed on Sep. 13, 2005, the entire contents of which are hereby incorporated by reference.

What is claimed is:

1. An image forming apparatus including a plurality of sheet feeding sources, the image forming apparatus comprising:

an acquiring unit configured to acquire a setup related to a position of the sheet feeding sources and a sheet feeding source search order, wherein the search order defines ranks for all possible combinations of sheet feeding source names and setups related to the search order of sheet feeding sources regardless of conditions of trays installed in the image forming apparatus, each of the acquired ranks represents a setup of a sheet feeding source, which setup is available in the image forming apparatus; and the acquiring unit assigns a highest rank to a sheet feeding source specified as a prioritized sheet feeding source among the sheet feeding sources; and a selecting unit configured to select, from among the sheet feeding sources, a sheet feeding source that satisfies a user specification and whose rank is highest, wherein the selecting unit determines whether a sheet feeding source is already selected.

2. The image forming apparatus according to claim 1, further comprising:

at least one sensor configured to detect conditions of each of the sheet feeding sources, and output signals representing the conditions of each of the sheet feeding sources; and a controlling unit configured to receive the signals from the sensor and supply the signals to the acquiring unit; wherein the acquiring unit extracts setups of the sheet feeding sources from the signals.

3. The image forming apparatus according to claim 1, wherein the setup includes at least one of a sheet size, a sheet direction, a sheet type, and a sheet feeding source type that can be specified for each of the sheet feeding sources.

4. The image forming apparatus according to claim 1, wherein the search order defines the ranks by ascending order of lengths of sheet conveyance for the sheet feeding sources.

5. The image forming apparatus according to claim 1, wherein the search order defines the ranks by ascending order of lengths of sheet feeding paths for the sheet feeding sources.

6. The image forming apparatus according to claim 1, wherein the search order defines the ranks so that a sheet feeding source that can store a large quantity of sheets is ranked highest.

7. The image forming apparatus according to claim 1, wherein the user specification includes at least one of a sheet size, a sheet direction, and a sheet type.

8. A sheet feeding source selection method performed by an image forming apparatus including a plurality of sheet feeding sources, the sheet feeding source selection method comprising:

(a) acquiring a setup related to a position of the sheet feeding sources and a sheet feeding source search order, wherein the search order defines ranks for all possible combinations of sheet feeding source names and setups related to the search order of sheet feeding sources regardless of conditions of trays installed in the image forming apparatus, and each of the acquired ranks represents a setup of a sheet feeding source, which setup is available in the image forming apparatus; and assigning a highest rank to a sheet feeding source specified as a prioritized sheet feeding source among the sheet feeding sources;

(b) selecting, from among the sheet feeding sources, a sheet feeding source that satisfies a user specification and whose rank is highest, wherein the selecting unit determines whether a sheet feeding source is already selected; and (c) feeding a sheet from the selected feeding source.

9. The sheet feeding source selection method according to claim 8, further comprising a step of:

(c) receiving signals from at least one sensor configured to detect conditions of each of the sheet feeding sources, the signals representing the conditions of each of the sheet feeding sources; wherein the step (a) includes extracting setups of the sheet feeding sources from the signals.

10. The sheet feeding source selection method according to claim 8, wherein the setup includes at least one of a sheet size, a sheet direction, a sheet type, and a sheet feeding source type that can be specified for each of the sheet feeding sources.

11. The sheet feeding source selection method according to claim 8, wherein the search order defines the ranks by ascending order of lengths of sheet conveyance for the sheet feeding sources.

12. The sheet feeding source selection method according to claim 8, wherein the search order defines the ranks by ascending order of lengths of sheet feeding paths for the sheet feeding sources.

13. The sheet feeding source selection method according to claim 8, wherein the search order defines the ranks so that a sheet feeding source that can store a large quantity of sheets is ranked highest.

14. The sheet feeding source selection method according to claim 8, wherein the user specification includes at least one of a sheet size, a sheet direction, and a sheet type.

15. A computer-readable recording medium, executable by a computer, that stores therein a sheet feeding source selection program that causes an image forming apparatus including a plurality of sheet feeding sources to execute the steps of:

(a) acquiring a setup related to a position of the sheet feeding sources and a sheet feeding source search order, wherein the search order defines ranks for all possible combinations of sheet feeding source names and setups related to the search order of sheet feeding sources regardless of conditions of trays installed in the image forming apparatus, and each of the acquired ranks represents a setup of a sheet feeding source, which setup is available in the image forming apparatus; and assigning a highest rank to a sheet feeding source specified as a prioritized sheet feeding source among the sheet feeding sources;

(b) selecting, from among the sheet feeding sources, a sheet feeding source that satisfies a user specification and whose rank is highest, wherein the selecting unit determines whether a sheet feeding source is already selected; and (c) feeding a sheet from the selected feeding source.

* * * * *